United States Patent [19]

Brantley

[11] 4,365,395

[45] Dec. 28, 1982

[54] APPARATUS FOR HANDLING TEXTILE FILAMENTARY MATERIAL

[75] Inventor: Zachry G. Brantley, Spartanburg, S.C.

[73] Assignee: Hoechst Fibers Industries, Division of American Hoechst Corporation, Spartanburg, S.C.

[21] Appl. No.: 134,949

[22] Filed: Mar. 28, 1980

[51] Int. Cl.[3] ..... B65H 17/50; D02C 1/18

[52] U.S. Cl. ..... 28/281; 19/65 T; 19/66 T; 19/296; 226/118; 226/196; 226/197; 226/199

[58] Field of Search ..... 226/97, 196, 197, 118, 226/200, 199; 19/160, 161.1, 163, 65 T, 66 T, 296, 288; 28/265, 266, 281

[56] References Cited

U.S. PATENT DOCUMENTS

| | | | |
|---|---|---|---|
| 2,991,502 | 7/1961 | Becker et al. | 19/65 T |
| 3,007,226 | 11/1961 | Becker et al. | 28/266 |
| 3,125,268 | 3/1964 | Bartholomay | 226/97 |
| 3,302,839 | 2/1967 | Spruill | 226/196 |
| 3,408,713 | 11/1968 | Parker et al. | 28/266 X |
| 3,420,425 | 1/1969 | Haddon et al. | 226/196 |
| 3,439,394 | 4/1969 | Gray et al. | 28/266 X |
| 3,548,783 | 12/1970 | Knapp | 226/197 X |
| 3,882,578 | 5/1975 | Izawa | 28/266 |
| 4,324,353 | 4/1982 | Brantley | 28/281 X |

OTHER PUBLICATIONS

Neumae Brochure of Neumunstersche Maschinen- und Apparatebau Gessellschaft m.b.H.

*Primary Examiner*—Louis Rimrodt

*Attorney, Agent, or Firm*—Luke J. Wilburn, Jr.; Wellington M. Manning, Jr.

[57] ABSTRACT

Static tow inverting apparatus for inverting the overlap of overlapping layers of a continuous length filamentary tow band of textile material deposited onto the surface of a moving conveyor in relaxed condition for treatment, such as in the thermal heat setting treatment of a band of tow which has been subjected to a mechanical crimping operation. The tow inverter comprises a pair of stationary plates which are disposed above the surface of a moving conveyor to receive a continuous length of tow in a plurality of overlapping layers thereon. The opposed surfaces of the spaced plates define a downwardly curving passageway for gravitational conveyance of the overlapping layers of tow through a reversing direction of movement to deposit the same on the surface of the moving conveyor with preceding layers of tow overlying succeeding layers of tow in the direction of movement on the conveyor. The tow is thereafter longitudinally withdrawn from the conveyor surface with minimum disruption of the layers and individual filaments therein. The two plates are respectively manually horizontally and vertically positionable to accommodate tow bands of varying size, width and dimensional configuration, and one of the plates is supported for pivotal movement about a horizontal axis in response to a predetermined pressure exerted thereon to prevent possible blockage of the inverter by tow in the inverter passageway. Means are provided for adjusting the downward slope of a surface of one of the plates, if desired, to facilitate gravitational movement of the overlapping layers of tow through the tow inverter.

9 Claims, 7 Drawing Figures

APPARATUS FOR HANDLING TEXTILE FILAMENTARY MATERIAL

The present invention relates to apparatus for handling textile filamentary material, and, more particularly, to an improved filamentary tow inverter for reversing the lay of tow being continuously deposited in overlapping layers onto a moving conveyor for processing.

BACKGROUND OF THE INVENTION

In the manufacture of synthetic textile fibers and yarns, it is well known to process filamentary material in tow form, i.e., a relatively large continuous band or cable of multiple filaments, particularly in the manufacture of staple fibers wherein the multifilament tow is subsequently cut into staple length for use in nonwoven or synthetic blend fabric products. In such processing, the tow band is often subjected to a mechanical crimping operation, after which it is subjected to a heat setting operation under relaxed conditions. Typically, this is accomplished by continuously depositing the flattened, crimped band of tow, immediately after crimping, in relaxed, overlapping loops or layers across the surface of a horizontally moving conveyor which transports the layers through a heating oven for thermal treatment, such as heat setting. After thermal treatment, the band of tow is continuously longitudinally withdrawn from the surface of the moving conveyor for further processing or collection. In continuously depositing and recovering the tow from the moving conveyor, care must be taken to ensure that the tow is deposited on and withdrawn from the conveyor surface with minimum disturbance, displacement, or entanglement of the overlapping layers of tow. If the tow is deposited directly across the moving conveyor from a feed point such that preceding layers in the direction of movement of the conveyor normally underlie next succeeding layers, it can be appreciated that during tow removal from the conveyor after treatment, the tow will always be longitudinally withdrawn from an underlying layer of the overlapped layers on the conveyor surface. Such a procedure causes disruption, displacement, or entanglement of the filamentary tow, with consequent undesirable results in processing.

To reduce disruption or entanglement of the tow layers during removal from the conveyor, certain apparatus has been employed for inverting, or reversing, the lay of the overlapping layers of tow deposited on the conveyor such that preceding layers of tow on the conveyor are reoriented to lie on top of next succeeding layers. Such tow-inverting apparatus, as far as known in the prior art, consist of moving belts or drums which convey the layers of tow through a curvilinear path to reverse their direction of overlap on the moving conveyor so that topmost layers of tow are first withdrawn from the conveyor after thermal treatment. One such device, manufactured by Neumag Division of Gruppe Deutsche Babcock of Germany, comprises a moving conveyor belt and rotating drum arrangement which are spaced apart to form a moving feed trough into which a continuous length of tow is deposited in successive overlapping layers. The layers are transported by the moving drum and belt surfaces in a curvilinear path to reverse the direction of overlap of the layers and locate each preceding layer on top of the next succeeding layer in the direction of conveyor belt movement. In this way, continuous removal of the tow from the conveyor after the thermal treatment draws consecutive topmost layers of the overlapping tow from the belt, rather than underlying layers of the tow, as would be the case if the lay of the tow were not inverted.

The above-described moving belt and drum type tow inverter apparatus has certain drawbacks and disadvantages. The layers and individual filaments processed therein are often disturbed, displaced or otherwise entangled during passage through the inverter. In addition, the moving belt/rotating drum type tow inverter is of considerable size and expense, with numerous moving parts, adding to capital outlay as well as normal operating expenses of the tow processing operation.

OBJECTS OF THE INVENTION

It is therefore an object of the present invention to provide an improved apparatus for inversion of consecutive overlapping layers of filamentary tow being deposited on a moving conveyor which is less expensive to manufacture and operate, and provides more reliable operation than known tow inverter equipment of the prior art.

It is another object to provide a more simplified tow inverter having non-moving tow-guiding surfaces which may be employed to efficiently and effectively gravitationally guide the same in a curvilinear path to invert the tow layers as they are deposited onto a conveyor surface, with minimum disruption of the filaments or layers of tow being deposited thereon.

It is a further object to provide an improved static tow inverter apparatus which may be positionally adjusted to accommodate and effectively handle inversion of overlapping tow layers of varying size, weight, and dimensional configuration.

It is another object to provide a simplified static tow inverter and thermal treating device of economical construction which may be employed in connection with treatment of a continuously moving band of tow with reduced heat losses from the heating oven in which the tow is thermally treated.

BRIEF DESCRIPTION OF THE DRAWINGS

The above, as well as other objects of the present invention will become more apparent, and the invention will be better understood, from the following detailed description of a preferred embodiment of the invention, when taken together with the accompanying drawings, in which.

BRIEF SUMMARY OF THE INVENTION

Broadly, the present invention comprises a static tow inverter for inverting, or reversing the direction of overlap of, consecutive overlapping layers of filamentary tow being deposited onto the surface of a moving conveyor such that preceeding layers of the tow deposited onto the conveyor surface overlie next succeeding layers of the tow, whereby the tow may be longitudinally continuously withdrawn from the surface of the conveyor after thermal treatment with minimal disruption, displacement, or entanglement of the tow layers. More specifically, the tow inverter comprises static, non-moving guide surfaces composed of a pair of curved, smooth tow-guiding plates which are adjustably positionable in spaced relation to form a longitudinally downwardly curving passageway for gravitational conveyance of consecutive layers of overlapping tow which are initially deposited on an upper surface of one of the plates. The consecutive overlapping layers are guided in sliding engagement with the opposed plates through a reversing arcuate path to invert and deposit the same on the moving conveyor with preceding layers overlying succeeding layers. Support means are provided for the plates to permit adjustable positioning of one of the plates in a vertical direction and the other of the plates in a horizontal direction to accommodate tow bands of varying composition, width and dimension.

Details of the specific means for adjustably supporting the guide plates, and additional features for pivotal movement of one of the plates away from the other plate, are described herein for completeness of disclosure of the preferred mode of my invention; however, such details form the subject matter of my joint invention described and claimed in a copending Brantley and Goode U.S. patent application Ser. No. 135,479, filed Mar. 31, 1980, now U.S. Pat. No. 4,324,353.

DETAILED DESCRIPTION OF THE INVENTION

Figure 1:
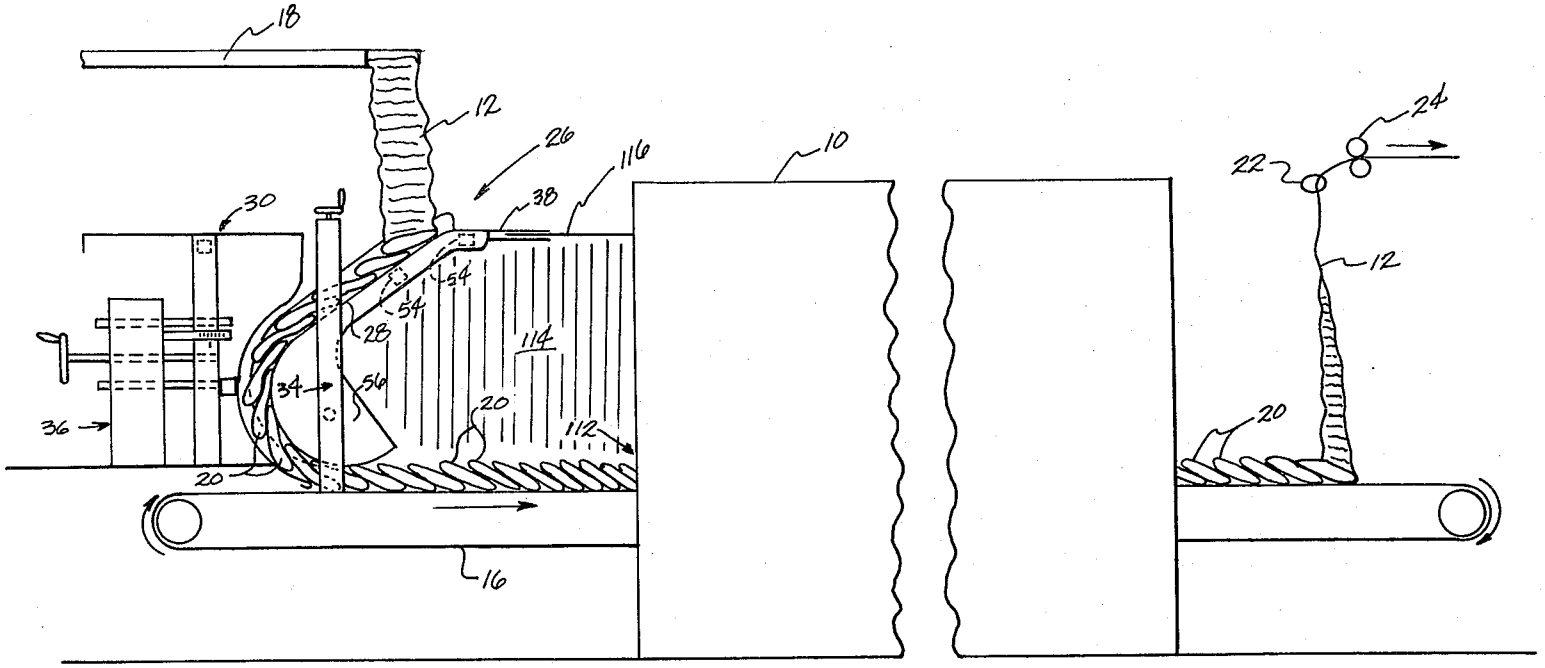
FIG. 1 is an overall schematic side elevation view of apparatus for thermally treating filamentary tow in continuous length form, and incorporating the static tow inverter of the present invention.

Referring more particularly to the drawings, FIG. 1 illustrates, in schematic side elevation view, apparatus for the thermal treatment of a continuously moving indefinite length filamentary tow. As illustrated, the treating apparatus includes an elongate enclosed heating oven or compartment 10 having an inlet and an outlet through which a continuous length of filamentary tow 12 is passed in relaxed condition on a continuously moved horizontal conveyor 16. The filamentary tow material, in the form of a flat band, is continuously fed to the conveyor 16 through a moving chute 18, commonly referred to as a "piddler" chute, which is suitably reciprocated or oscillated in known manner across a desired width of the conveyor to gravitationally deposit the tow in relaxed condition in a plurality of overlapping layers 20 (FIGS. 1 and 2) extending transversely to the direction of conveyor movement. After passage through heating oven 10, the tow is continuously withdrawn from the conveyor surface in an upward direction through a suitable guide member 22 by driven rolls 24 or other means for further processing or collection.

Figure 2:
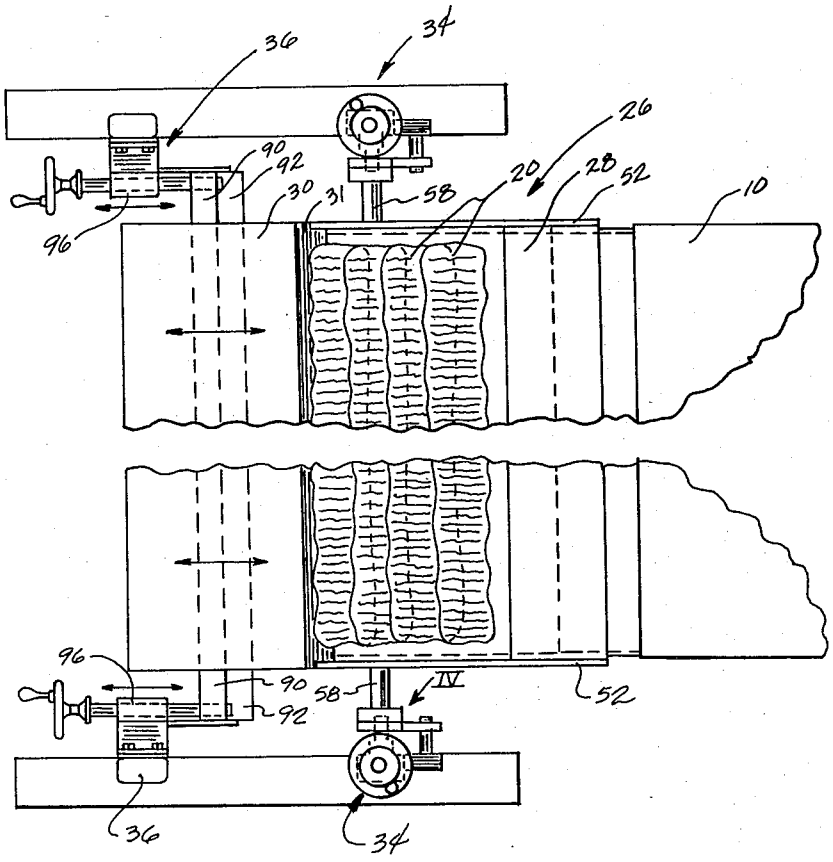
FIG. 2 is a plan view of end portions of the tow inverter section of the apparatus of FIG. 1, showing the means for adjustably mounting the guide members of the inverter at opposite sides of the horizontal conveyor of the treating apparatus.
Figure 3:
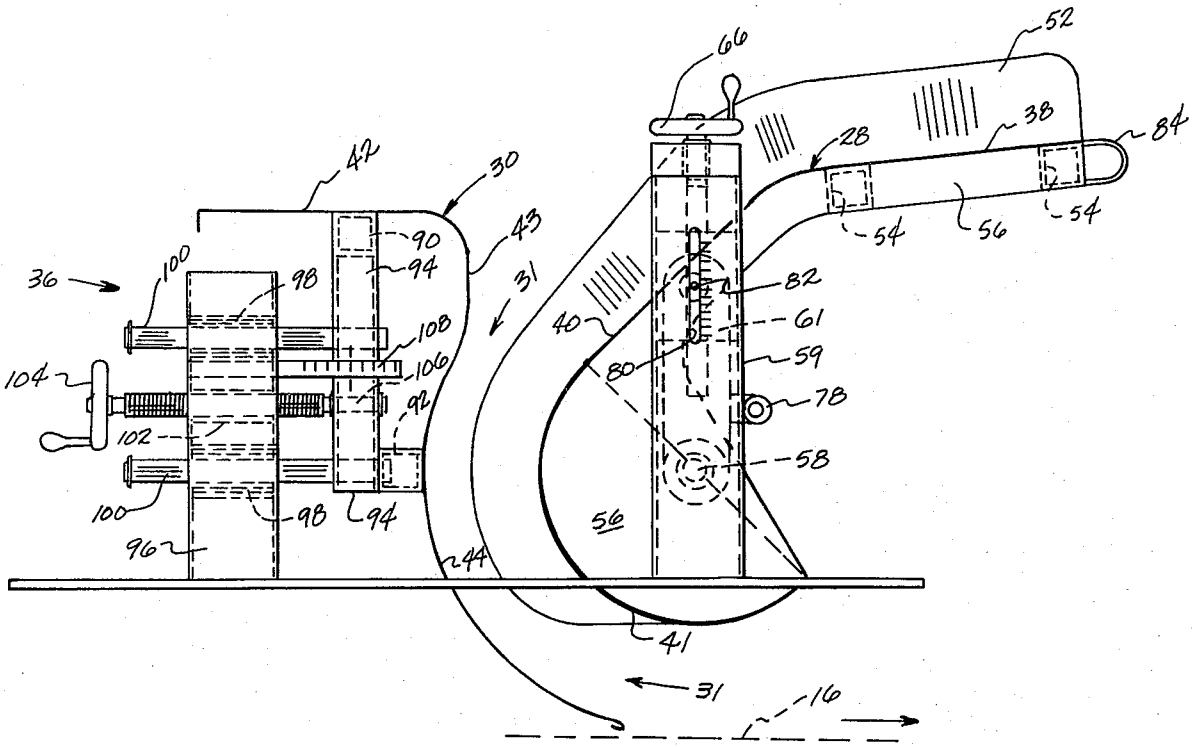
FIG. 3 is an enlarged side elevation view of the static tow inverter of FIG. 1, showing in more detail the arrangement of component parts and adjustable mounting means for supporting the same.

As seen in FIGS. 1 and 2, positioned directly above and extending across the surface of moving conveyor 16 in the path of the tow 12 being fed from the reciprocating piddler chute 18 is a static tow inverter 26 of the present invention. As best seen in FIGS. 1–3, the inverter 26 includes first and second stationary curved tow-guiding plates 28, 30 which extend across the width of the conveyor 16 and have opposed smooth surfaces located in spaced relation to define a relatively narrow longitudinally curved passageway 31 for gravitationally conveying layers of tow deposited onto the upper surface of plate 28 downwardly onto the surface of conveyor 16. As seen in FIG. 1, the plate 28, 30 cause the overlapped layers 20 of tow to move through a reversing path to reverse the direction of movement of the layers and thereby invert the overlap of the layers before their deposit on the surface of conveyor 16.

The two curved plates 28, 30 are formed of suitable material, such as smooth sheet metal, or the like, and are separately supported at their ends by respective adjustable support means 34, 36 located on opposite sides of the horizontal conveyor 6. As best seen in FIG. 3, forward guide plate 28 has a first generally horizontal upper support surface portion 38, a second surface portion 40 which extends downwardly and rearwardly with respect to the direction of movement of conveyor 16, and a third arcuately curved lower portion 41 which extends forwardly to lie in spaced relation above the upper surface of conveyor 16. Rear guide plate 30 has an upper horizontal surface portion 42, a short downwardly extending generally vertical surface portion 43, and an arcuately curved surface portion 44 generally concentric with the arcuately curved surface portion 41 of forward guide plate 28. The two plates 28, 30 thus define a longitudinally curved passageway 31 for guiding the layers of tow from their point of deposit on the upper surface portion 40 of plate 28 downwardly and onto the upper surface of the main conveyor 16 (Note FIG. 1).

As illustrated in FIGS. 1 and 2, as the piddler chute 18 reciprocates across the upper surface of the front plate 28, the flattened band of tow 12 falls downwardly to be deposited in a plurality of overlapping layers 20, with subsequent layers formed on the sloping surface portion 40 of the front plate 28 overlying the preceding layers deposited thereon. The weight of the tow on the inclined surface portion 40 of plate 28 causes gravitational downward movement of the layers through the passageway 31 formed between the two plates 28, 30 as the layers of tow are transported away from the lower discharge outlet of the passageway in a horizontal direction by moving conveyor 16. The curved shape of the passageway causes the direction of movement of the layers 20 to reverse to invert their direction of overlap, such that the layers are deposited onto the surface of conveyor 16 at the lower discharge opening of passageway 31 with preceding layers in the direction of movement of conveyor 16 overlying the next succeeding layers. The tow layers are conveyed through the heating oven in relaxed condition for thermal treatment, and at the discharge end of the conveyor, as seen in FIG. 1, the tow is longitudinally withdrawn in an upward direction, with successive topmost overlying layers of the tow being consecutively removed from the conveyor surface without disturbing underlying layers.

As best seen in FIGS. 2 and 3, located adjacent side edges of the forward guide plate 28 at either side of the conveyor are vertical guide walls 52 which are laterally positionable and ensure retention of the overlapped layers of tow in the passageway 31 of the inverter.

Figure 4:
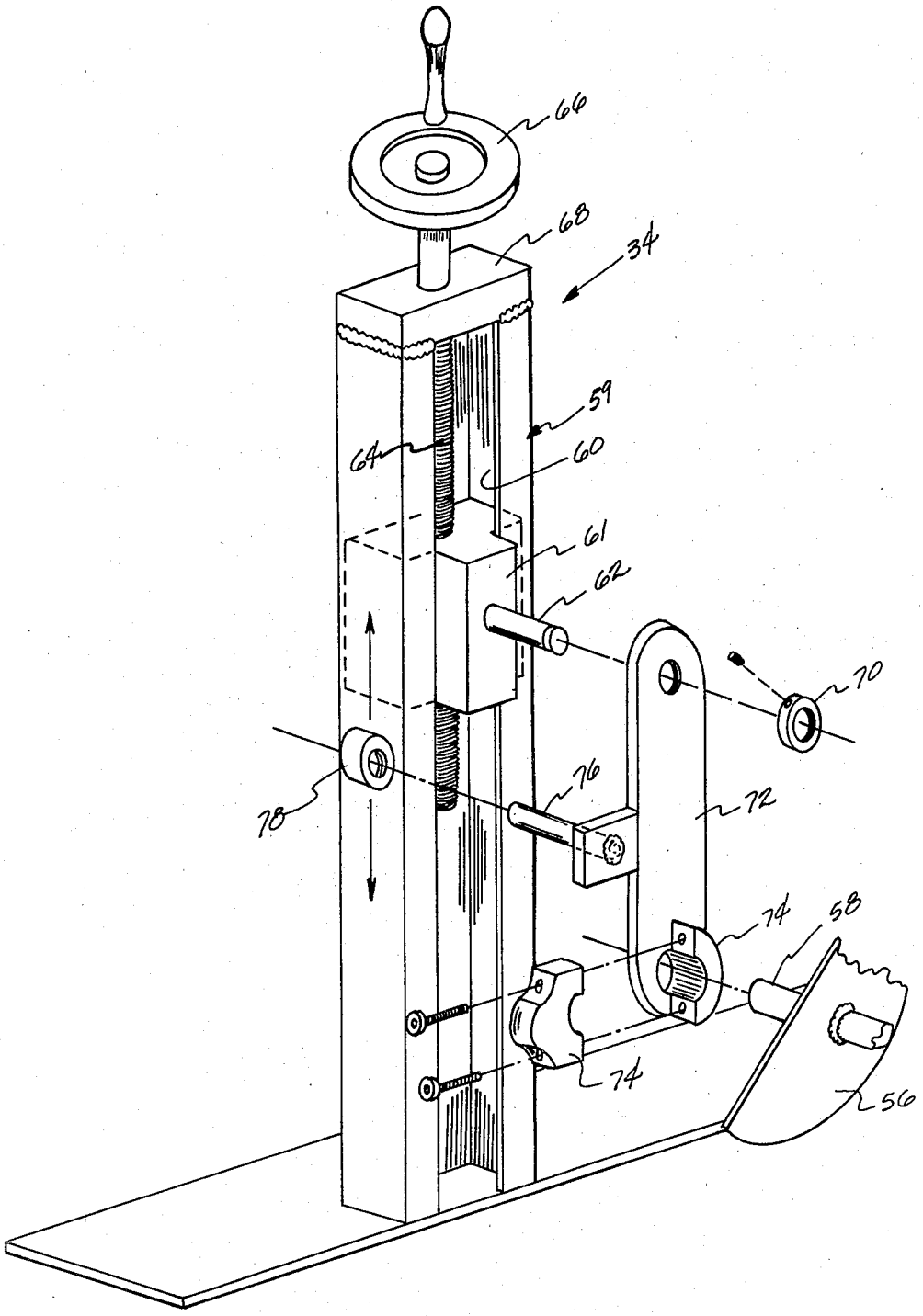
FIG. 4 is an enlarged, exploded perspective view of one of the end support members for adjustably positioning one of the tow-guiding members of the inverter, looking generally in the direction of arrow IV in FIG. 2.

Depending upon the size and width of the flattened tow band to be thermally treated, guide plates 28, 30 may be positionably adjusted to ensure proper sliding engagement of the layers with the plates to invert the layers during passage through the inverter. Details of the manner in which the guide plates 28, 30 are supported for adjustment are best explained by reference to FIGS. 2-4. As seen in FIG. 4, front guide plate 28 is reinforced by one or more transverse channel members 54 attached to the undersurface of the plate, as by welding, which extend across the width of the plate between generally vertical end wall support members, one of which, 56, is seen in FIGS. 1 and 3. Depending upon the width of the conveyor 16, and the corresponding width of the guide plates 28, 30 necessary to span the same, guide plate 28 may be provided with additional vertical support walls at spaced locations along the undersurface between the end wall supports. A support shaft 58 fixedly attached to the vertical end wall supports and extending across the full width of plate 28, has end portions which are attached to the adjustable support means 34 on either side of conveyor 16, as will be explained.

As best seen in FIG. 4, which is an enlarged, exploded perspective rear view of one of the adjustable support means 34, each adjustable support means 34 comprises an inverted U-shaped guide member 59 forming opposed vertical channels 60 in which a movable block 61 with pivot pin 62 is mounted for vertical sliding movement. Block 61 has an internally threaded vertical passageway and is adjustably positioned along the vertical channels by means of a threaded bolt 64 with hand wheel 66 rotatably mounted in an upper horizontal cross-piece 68 of guide member 59. Pivotally attached to the pivot pin 62 by means of a retaining collar 70 is a swing arm 72 having a lower opening with split-ring clamping collar 74 for receipt of the adjacent end of the support shaft 58 of guide plate 28. Swing arm 72 is provided with an offset horizontal guide bar 76 with roller 78 which engages and moves along the outside vertical surface of guide member 59 during vertical adjustment of the block 61 to prevent clockwise pivotal movement of the swing arm, as viewed in FIG. 4.

As seen in FIG. 3, the outside face of each guide member 59 is provided with a calibrated slot 80 which receives an indicator pin 82 on movable block 61. Thus the hand wheel 66 of each support means 34 may be rotated to vertically position the lower surface portion 41 of the guide plate 28 at a desired uniform distance above the surface of horizontal conveyor 16.

Figure 5B:
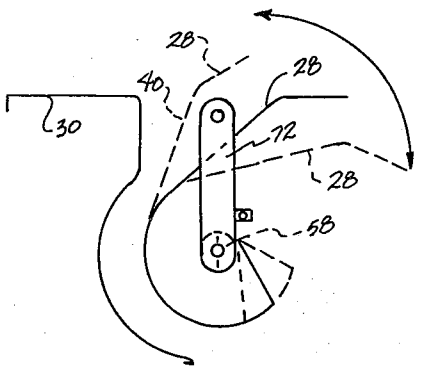
FIGS. 5*a* through 5*c* illustrate schematically the directional adjustments which may be made in the static tow inverter of the present invention.

As seen in FIG. 3, the upper forward end of guide plate 28 is provided with a handle 84. Guide plate 28 on its supporting swing arms 72 may thus be pivoted manually, or in response to excess pressure of tow in the passageway 31 between the guide plates, in a counterclockwise direction (as viewed in FIG. 3) about pivot pin 62 to move the lower surface of plate 28 away from the surface of guide plate 30 and the upper surface of conveyor 16. Such pivotal movement is illustrated schematically in FIG. 5*c* and serves to prevent, or clear, any temporary blockage of tow layers in passageway 31, should such tend to occur during movement of the tow through the inverter.

As best seen in FIGS. 2 and 3, the rear guide plate 30 is reinforced by transverse channel members 90 and 92 which extend across the width of the plate and are attached to the undersurface thereof, as by welding. Transverse channel members 90 and 92 are interconnected by a vertical channel member 94 which is operatively attached to and supported for horizontal movement on the adjustable support means 36 located at each side of the main conveyor 16. Each adjustable support means 36 for rear guide plate 30 comprises a vertical support member 96 having horizontal openings with sleeve bearings 98 which slidably receive horizontal guide rods 100 attached to the vertical member 94. Support member 96 also has an internally threaded horizontal passageway 102 in which is received a threaded bolt and hand wheel adjustment device 104, the outer end of which is rotatably attached to the vertical member 94 by means of a thrust bearing 106. Each adjustable support means 36 for plate 30 is further provided with a horizontal calibrated plate 108 and indicator mark on the vertical channel member 94, such that the hand wheel 104 of each support means 36 may be rotated to adjustably uniformly position guide plate 30 along a horizontal axis, and thereby vary the distance of rear guide plate 30 from the front guide plate 28. Such horizontal adjustment of plate 30 is illustrated schematically in FIG. 5*a*.

Figure 5A:
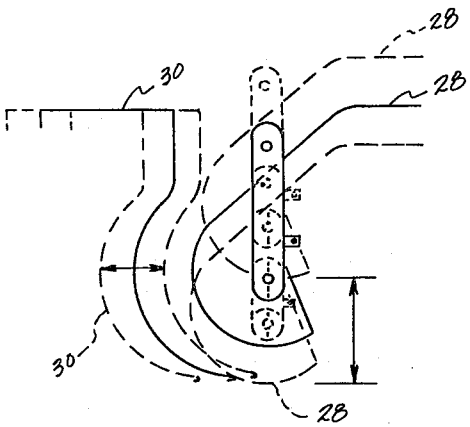
Figure 5C:
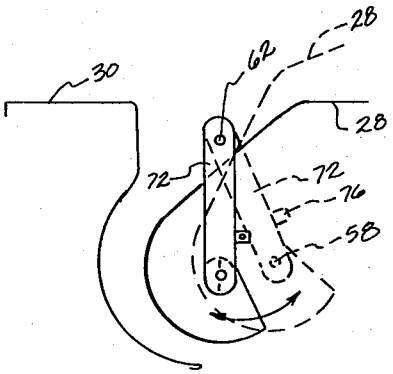

Thus, the forward guide plate 28 may be adjustably positioned along a vertical axis, as illustrated in FIG. 5*a*, to vary the distance of the lower surface of the plate from the upper surface of the conveyor 16, while the rear guide plate is horizontally positionable to vary the size of the passageway between the two plate surfaces. In this manner, the plates can be positioned to accommodate and effectively invert tow bands of varying width and dimensional configuration.

Although an angle of approximately 45° on the downwardly sloping surface portion 40 of front guide plate 28 has been found satisfactory for most tow inversion; the angle of the slope may be varied, if needed, to facilitate movement of the tow layers through the inverter passageway for inversion of the same. As seen in FIG. 4, by loosening the split ring collars 74 holding the respective end portions of the support shaft 58 and manually rotating plate 28 about the axis of the shaft, the angle of slope of portion 40 may be increased or decreased, as illustrated schematically in FIG. 5*b*.

In a preferred embodiment of use of the static tow inverter of the present invention, the area of the main conveyor 16 between the inverter and the inlet opening 112 of the heating oven 10 may be totally enclosed by a suitable housing to minimize heat loss from the heating oven. As seen in FIG. 1, the housing comprises stationary upright vertical side walls, only the far wall 114 of which is shown, and a top wall which includes an adjustable extension plate 116 attached to the upper surface portion 38 of the front guide plate 28 which engages the heating oven 10 to effectively seal the area between the tow inverter and the oven inlet. In such an enclosed arrangement, proper vertical adjustment of the front guide plate 28 with respect to the distance of surface 41 of the plate from the surface of the main conveyor 16 may be maintained to ensure that the tow layers 20 passing through the inverter passageway form an effective seal against loss of heat from the enclosure housing.

That which is claimed is:

1. A stationary tow inverter for depositing a continuous length of tow onto the surface of a moving conveyor in a plurality of overlapping layers with preceding layers of the tow overlying next succeeding layers in the direction of movement of the conveyor, comprising:

tow guiding means defining a first stationary support surface for receiving a continuous length of tow deposited thereon in a plurality of overlapping layers with preceding layers underlying next succeeding layers deposited thereon, and a second stationary support surface spaced from said first surface and cooperating therewith to gravitationally convey and guide the overlapping layers of tow through a downwardly curved path to reverse the direction of lay of the overlapping layers and deposit the same onto a conveyor surface with preceding layers of tow overlying next succeeding layers in the direction of movement of the conveyor.

2. Apparatus as defined in claim 1 wherein said first and second stationary support surfaces of said tow guiding means define an elongate, generally arcuate path for gravitational movement of the overlapping layers of tow through an approximate reversal of direction of movement from their initial deposition on said first surface to their final deposition on the moving conveyor surface.

3. Apparatus as defined in claim 1 wherein said tow guiding means comprises first and second guide plates defining said respective first and second stationary support surfaces; said first guide plate having a first downwardly sloping surface portion for continuously receiving a length of the tow in a plurality of overlapping layers extending across a width of the first plate while gravitationally conveying the tow deposited on the first plate in a first rearward direction, and a second lower arcuately curved surface portion extending downwardly and forwardly of said first downwardly sloped surface portion for continued guidance of the layers of tow during their gravitational downward movement; and said second guide plate including an arcuately curved surface portion spaced rearwardly of said second surface portion of said first guide plate and being generally concentrically curved therewith to form an arcuate passageway for gravitational downward and forward guidance of said overlapping layers of tow onto the surface of a moving conveyor.

4. Apparatus as defined in claim 3 wherein said tow guiding means includes support means for adjustably positioning said first plate in a vertical direction to vary the distance of the lowermost surface portion of the first plate from the upper surface of a moving conveyor on which the overlapping layers of tow are deposited, and support means for adjustably positioning said second plate in a horizontal direction to vary the distance between said first and second plates.

5. Apparatus for treating a continuously moving filamentary band of tow including a generally horizontally moving conveyor for transporting the tow for treatment in relaxed condition and in a plurality of overlapping layers extending transversely across at least a portion of the conveyor width, tow feeding means positioned above the conveyor and movable in reversing directions generally transverse to the direction of movement of the conveyor for continuously gravitationally feeding a running length of tow downwardly toward the surface of the conveyor, and tow withdrawing means for continuously longitudinally withdrawing the layers of tow from the conveyor after treatment thereon, tow inverting means positioned below and in the path of movement of the tow from the tow feeding means and having first and second stationary tow guiding surfaces positioned above and extending in horizontally spaced relation from each other across at least a portion of the conveyor surface to define a downwardly curving passageway for initially receiving the length of tow from said tow feeding means in a plurality of overlapping layers with preceding layes underlying next succeeding layers, and for gravitationally conveying and guiding the layers of tow while substantially reversing the direction of movement of the overlapping layers to invert their overlap and deposit the same onto the surface of the moving conveyor with preceding layers of tow overlying next succeeding layers in the direction of movement of the conveyor.

6. Apparatus as defined in claim 5 wherein said first tow guiding surface has an upper downwardly and rearwardly sloping portion relative to the direction of movement of the conveyor and a lower arcuate surface portion extending downwardly and forwardly with respect to the direction of movement of the conveyor, and wherein said second tow guiding surface has an arcuately shaped portion spaced rearwardly from and lying generally concentric with said arcuately shaped portion of said first tow guiding surface.

7. Apparatus as defined in claim 6 wherein said tow guiding means includes support means for adjustably positioning said first guide surface along a vertical axis to vary the distance of said surface for the upper surface of the conveyor, and support means for said second tow guiding surface for varying the position of said second surface along a horizontal axis to vary the distance of said second surface from said first surface.

8. Apparatus as defined in claim 5 including a heating oven disposed about said horizontal conveyor between said tow guiding means and said tow withdrawing means for thermal treatment of the layers of tow on the surface of the conveyor passing through said oven, and an enclosure housing overlying said conveyor between said tow inverting means and the inlet to said heating oven to seal the same against loss of heat from the inlet opening of said oven.

9. Apparatus as defined in claim 8 wherein said housing includes an adjustably extendible plate attached to said tow inverting means for engagement with said heating oven.

* * * * *

UNITED STATES PATENT AND TRADEMARK OFFICE

CERTIFICATE OF CORRECTION

PATENT NO. : 4,365,395

DATED : December 28, 1982

INVENTOR(S) : Zachry G. Brantley

It is certified that error appears in the above-identified patent and that said Letters Patent are hereby corrected as shown below:

Column 3, line 53, "moved" should read--moving--.

Column 4, line 11, "plate" should read--plates--.

Column 8, claim 7, line 38, "for" should read--from--.

Signed and Sealed this

*Fifteenth* Day of *March 1983*

[SEAL]

*Attest:*

GERALD J. MOSSINGHOFF

*Attesting Officer*

*Commissioner of Patents and Trademarks*